US008307895B2

(12) United States Patent
Lund

(10) Patent No.: US 8,307,895 B2
(45) Date of Patent: Nov. 13, 2012

(54) IMAGING APPARATUS AND METHODS OF MAKING AND USING SAME

(75) Inventor: Hans-Jacob Lund, Hafrsfjord (NO)

(73) Assignee: ConocoPhillips Company, Houston, TX (US)

( * ) Notice: Subject to any disclaimer, the term of this patent is extended or adjusted under 35 U.S.C. 154(b) by 288 days.

(21) Appl. No.: 12/711,369

(22) Filed: Feb. 24, 2010

(65) Prior Publication Data

US 2010/0212890 A1 Aug. 26, 2010

Related U.S. Application Data

(60) Provisional application No. 61/155,676, filed on Feb. 26, 2009.

(51) Int. Cl.
*E21B 47/09* (2012.01)
*G01B 5/20* (2006.01)

(52) U.S. Cl. ..... 166/255.1; 33/561.1

(58) Field of Classification Search ..... 166/255.1, 166/98; 33/561.1
See application file for complete search history.

(56) References Cited

U.S. PATENT DOCUMENTS

| | | | | |
|---|---|---|---|---|
| 2,824,378 | A * | 2/1958 | Stokes | 33/561.1 |
| 3,115,196 | A * | 12/1963 | Roxstrom | 175/44 |
| 3,425,507 | A | 2/1969 | Caldwell et al. | |
| 3,735,338 | A | 5/1973 | Aldrich et al. | |
| 4,488,747 | A | 12/1984 | Austin | |
| 4,653,196 | A * | 3/1987 | Moschner et al. | 33/552 |
| 4,766,577 | A | 8/1988 | Clerke et al. | |
| 6,009,948 | A | 1/2000 | Flanders et al. | |
| 6,041,860 | A | 3/2000 | Nazzal et al. | |
| 2005/0034894 | A1 * | 2/2005 | Beach et al. | 175/44 |

* cited by examiner

*Primary Examiner* — Kenneth L Thompson
(74) *Attorney, Agent, or Firm* — ConocoPhillips Company

(57) ABSTRACT

A method and apparatus for imaging objects present in a wellbore is provided. The method and apparatus use a plurality of actuatable members which can be axially displaced to form an image of the object and use an actuatable member displacement sensor to detect the displacement of the actuatable members.

20 Claims, 3 Drawing Sheets

IMAGING APPARATUS AND METHODS OF MAKING AND USING SAME

CROSS-REFERENCE TO RELATED APPLICATIONS

This application is a non-provisional application which claims benefit under 35 USC §119(e) to U.S. Provisional Application Ser. No. 61/155,676 filed Feb. 26, 2009, entitled "Imaging Apparatus and Methods of Making and Using Same," which is incorporated herein in its entirety.

STATEMENT REGARDING FEDERALLY SPONSORED RESEARCH OR DEVELOPMENT

None.

BACKGROUND

1. Field of the Invention

The present disclosure relates generally to wellbore servicing operations. More specifically, the present disclosure relates to an imaging apparatus and methods of making and using same.

2. Brief Description of the Prior Art

In wellbore servicing operations such as drilling, there may be undesirable objects present within a wellbore such as pieces of broken pipe or equipment, tools that have been dropped, or sand, debris, or scales located at the bottom of the wellbore, etc. These undesirable objects are typically referred to as "fish" and are typically removed as they tend to inhibit the wellbore servicing operations. Lead impression blocks are used in many phases of wellbore servicing operations to get an imprint which is a representation of the fish in order to determine the types, sizes, shapes, positions, and orientations of the fish. Typically, a lead impression block has a malleable lead base that can leave an imprint of the fish. Once the imprint from the lead impression block is interpreted and the fish is identified, an appropriate fishing tool may be selected accordingly to recover the fish.

For example, a fishing tool with hooks, spears, grabs, or pressure tight seals may be used to recover tools, equipment, and other wellbore objects such as pieces of pipe, tubing, and/or wire. In other instances, the fish may be sand, debris, or scales located at the bottom of a wellbore that is recoverable using a fishing tool such as a hydrostatic bailer.

Often however, lead impression blocks incur nicks, scratches, dents, and other deviations during the blocks' travel within the wellbore to the fish location. The lead impression blocks may also incur obfuscating impressions due to multiple encounters with the fish. In addition, wellbore conditions, such as the presence of a drilling mud, may further obfuscate the impression blocks' impressions further hindering the identification of the fish. Thus, there is a need for a more accurate, efficient, and economical method of identifying fish within a wellbore.

SUMMARY OF THE INVENTION

In one embodiment of the present invention, there is provided an apparatus for imaging within a wellbore comprising a base; a plurality of actuatable members disposed axially adjacent to the base; a drive mechanism to extend and contract the actuatable members; and an actuatable member displacement sensor.

In another embodiment of the present invention, there is provided a method of servicing a wellbore comprising providing an apparatus comprising a base and a plurality of actuatable members disposed axially adjacent to the base and an actuatable member displacement sensor; lowering the apparatus into the wellbore to a position near an object within the wellbore; contacting the actuatable members with the object wherein the contacting comprises axially displacing the actuatable members; forming a representation of the object; interpreting the representation of the object; and using the representation of the object to select a fishing tool to retrieve the object from the wellbore.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION OF THE PREFERRED EMBODIMENTS

It should be understood at the outset that although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Figure 1:
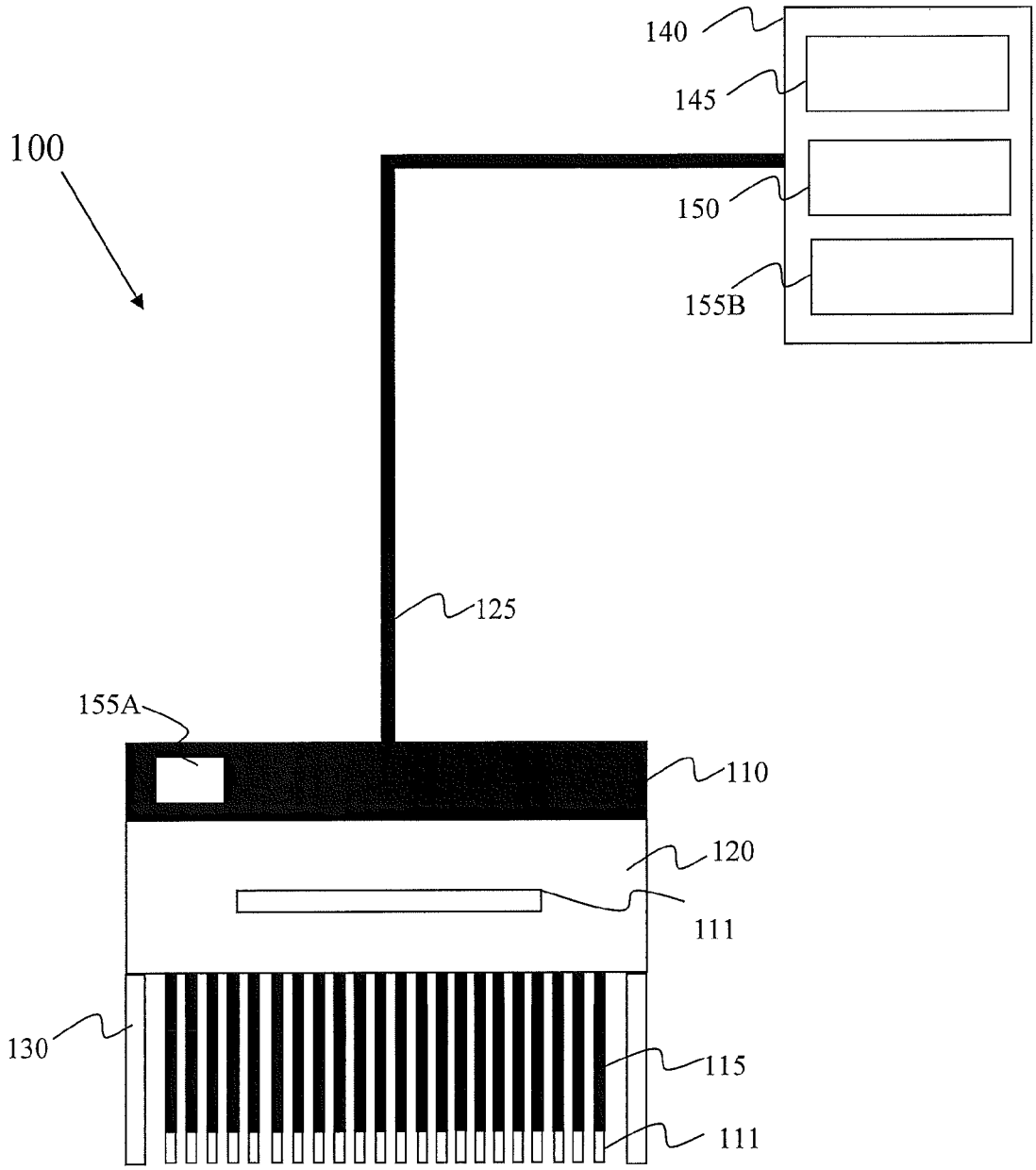
FIG. 1 is a side view of one embodiment of an intra-wellbore imaging apparatus.

Disclosed herein are intra-wellbore imaging apparatuses and methods for servicing a wellbore. For example, the apparatuses and methods disclosed herein are useful for obtaining imprints of objects within a wellbore. In an embodiment, an imaging apparatus comprises a base comprising a plurality of actuatable members. FIG. 1 illustrates an embodiment of an imaging apparatus 100 involved that may be employed in a wellbore servicing operation. Referring to FIG. 1, the imaging apparatus 100 comprises a base 110 and a plurality of actuatable members 115. The imaging apparatus 100 may further comprise one or more drive mechanisms 120, a line 125, a protective casing 130, one or more sensors 111, a means of transferring the data from the sensors to a down hole memory device or to the surface via an electric line. One of ordinary skill in the art with the aid of this disclosure will readily appreciate that various embodiments of the imaging apparatus may be designed by a one or ordinary skill in the art with the aid of this disclosure and utilized in wellbore servicing operation to obtain an imprint of an object within the wellbore.

In an embodiment, the base 110 may be configured to have a shape and dimension fitting within the wellbore. The shape and dimensions of the base 110 may be selected and designed by a user to achieve a user desired result. For example, the base 110 may be solid or hollow polyhedron, cylinder, sphere, cone, torus, or combinations thereof.

The base 110 may be constructed from any materials that can withstand wellbore conditions. For example, the base 110 may be constructed from metals such as iron, copper, aluminum, lead; alloys such as steel, brass, bronze or combinations thereof.

The actuatable members 115 will be axially aligned with the base 110 such that they may be axially displaced (as described below) without interfering with one another. The axial alignment will depend on the shape of the base ends, for example, if the base 110 is a sphere, axially aligning may include radially aligning.

The actuatable members 115 may comprise without limitation a plurality of pins, needles, sticks, welding sticks, rods, wand, spears, spikes, nails, or other objects which may be extendable thereof, contractable thereof, collapsible thereof, or combinations thereof. As used in the preceding sentence, extendable refers to the ability to extend, stretch out, elongate, or lengthen; contractable refers to the ability to contract, shorten, or shrink; and collapsible refers to the ability to collapse, fold in, or cave in compactly, such as in mechanical telescoping. The dimension and number of actuatable members 115, as well as the placement of actuatable members 115 in the base 110 may be designed by one of ordinary skill in the art with the aid of this disclosure to achieve a user desired results. Although different cross sectional shapes may be used for the actuatable member, it is preferred that the size of the actuatable member be on the order of having a diameter of less than about 2 cm. Preferably, the diameter is less than 5 mm and more preferably between 1 mm and 3 mm. Smaller diameters with a greater number of actuatable members is believed to provide higher resolution of the fish, but at a tradeoff to robustness of the actuatable members. The actuatable members 115 may be placed such that each actuatable member is separated from each other and may act independently of each other. The number of actuatable members 115 may be as high as possible as long as the members are strong enough not to break and not so close together that they negatively interfere with each other. The higher the density of the actuatable members, the higher the resolution of the image. Accordingly, there should be a plurality of actuatable members and preferably at least five actuatable members. In a preferred embodiment, the actuatable members 115 may be placed such that there are at least one per two $cm^2$ and more preferably at least one per $cm^2$.

The actuatable members 115 may be constructed from any materials that can withstand wellbore conditions, and may be the same or different materials than the materials of base 110. For example, the actuatable members 115 may be constructed from metals such as iron, copper, aluminum, lead; alloys such as steel, brass, bronze; organic polymers, synthetic polymers or combinations thereof.

In an embodiment, the actuatable members 115 are coupled to one or more drive mechanisms 120 to drive the axial displacement of the actuatable members. This drive mechanism may be a separate system for each actuatable members, such as a spring for each actuatable member; or the mechanism may be a system that affects all of the actuatable members at the same time, such as a hydraulic pressure chamber. The drive mechanism can be a spring, gravity, magnetic, hydraulic, or electric, but is not limited to these or a combination thereof. The drive mechanism system may or may not be able to both extend and retract the actuatable members in the axial direct. The drive system may or may not be controllable from the surface. An example of a non controllable drive system is springs. An example of a controllable drive system is a hydraulic chamber in which the pressure can be controlled from the surface.

The axial displacement of the actuatable members 115 of the type disclosed herein may be described in different states: extended state, contracted state, or displaced state. In the extended state, the distance between the fish-contacting portion of the actuatable members 115 and the base 110 is the greatest. In contracted state, distance between the fish-contacting portion of the actuatable members 115 and the base 110 is the least. In displaced state, the actuatable members 115 are somewhere in between the extended and contracted states.

The axial displacement of the actuatable member may be measured via a sensor 111 or a plurality of sensors. The axial displacement sensor 111 can be any type of sensor known to those of ordinary skill in the art with the aid of this disclosure capable of monitoring the axial movement of the actuatable members. The axial displacement sensor 111 or a plurality of sensors may be positioned on any portion or portions of the imaging apparatus, e.g., on the base, pressure chamber, or actuatable members, or combinations thereof, as necessary so that the sensors are capable of providing information regarding the axial movement of the actuatable members.

The state of the actuatable members 115 may be controllable. The actuatable members 115 may be controlled, for example at the extended state, prior to contact with an object. Upon contact with the object, one or more of the actuatable members 115 may be axially displaced following a contour of the object. If the object has a contour of different heights or distance with respect to the different members of the actuatable members 115, the axial displacement of the actuatable members 115 may be different from each other. Thus overall, the axially displaced members may form a representation of the object.

Alternatively, the actuatable members 115 may be controlled at the contracted state prior to contact with the object. The imaging apparatus 100 may be placed close to the object. The actuatable members 115 may then be extended to contact the object. Upon contact with the object, one or more of the actuatable members 115 may extend to a displaced state or to the extended state. Similarly, the axial displacement of the actuatable members 115 may follow the contour of the object and may form a negative impression of the object. The negative impression of the object may be analyzed to identify the object; e.g., the negative impression may be utilized to derive a positive impression, which may then be used to identify the object via visual inspection, comparison to a database items, or any other identification determining methods.

Figure 2:
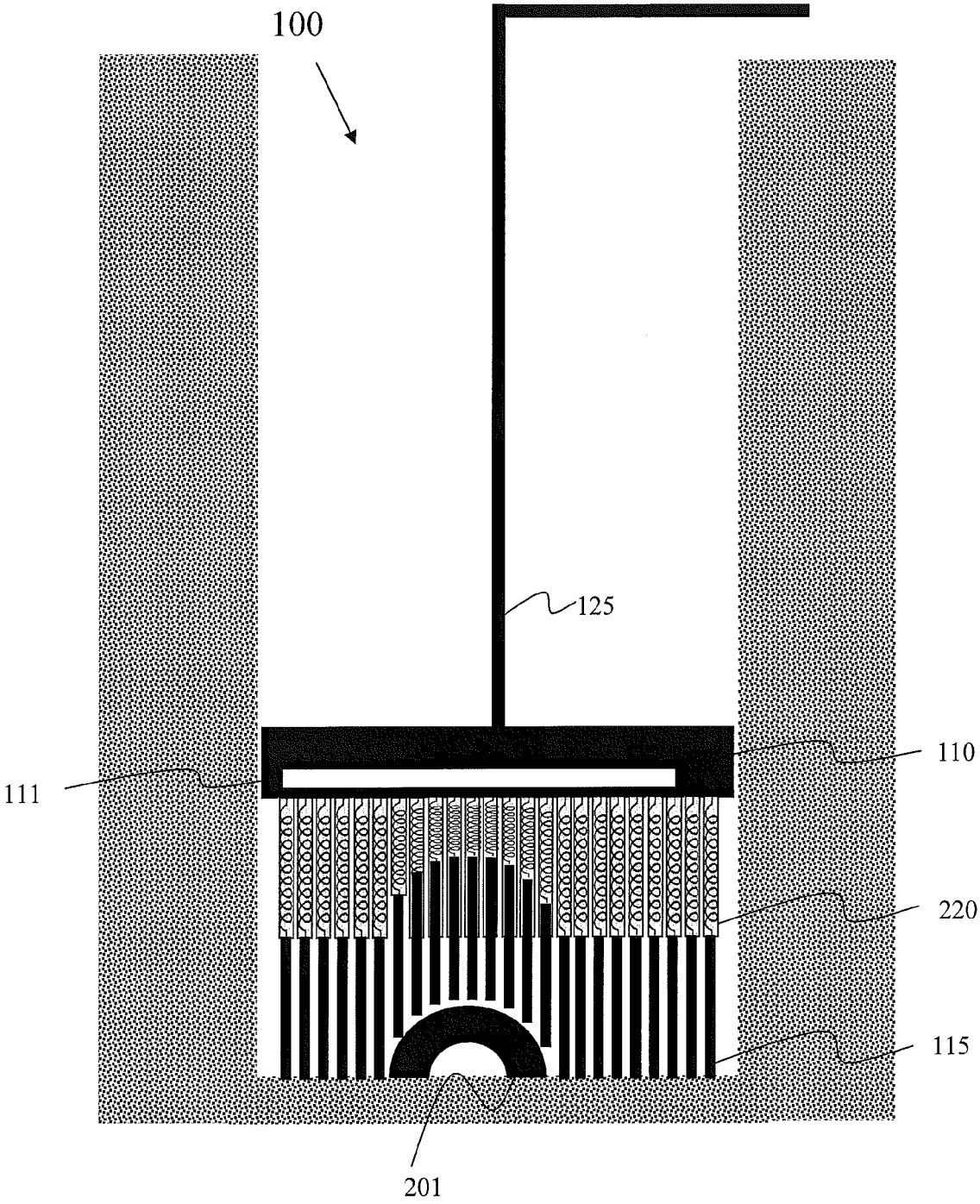
FIG. 2 is a side view of one embodiment of an intra-wellbore imaging apparatus to obtain the top imprints of a fish.

In an embodiment, an imaging apparatus 100 may be used to obtain an impression of the top of an object 201, as illustrated in FIG. 2. For example, the imaging apparatus 100 having a cylindrical plate shape base 110 may be lowered into a wellbore using a line 125 with actuatable members 115 in the extended state. The extended state of the actuatable members 115 may be controlled for example by using a spring loaded chamber 220. The pressure inside the spring loaded chamber 220 may be controlled at a pressure such that the actuatable members 115 are at the extended state. Upon contact with the object 201, the pressure of the spring loaded chamber 220 may be lowered further, and the imaging apparatus 100 may be allowed to contact the object 201. The actuatable members 115 may follow the top contour of the object 201 and form an impression of the top of the object 201.

Figure 3:
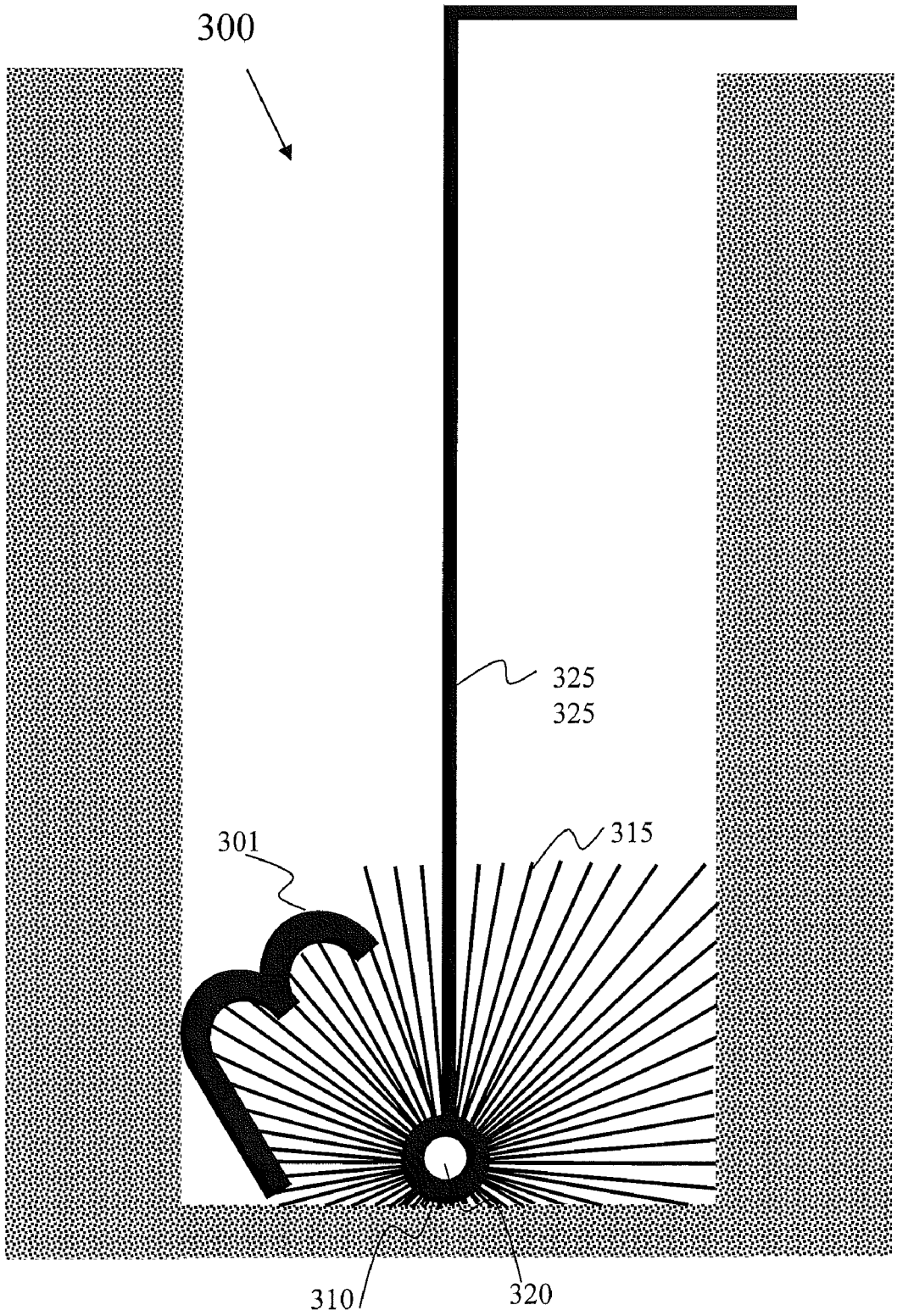
FIG. 3 is a side view of one embodiment of an intra-wellbore omni-directional imaging apparatus to obtain the side imprints of a fish.

In another embodiment, an omni-directional imaging apparatus 300 may be used to obtain an impression of the sides of an object 301, as illustrated in FIG. 3. For example, the imaging apparatus 300 having a sphere or cylindrical shape may be lowered into a wellbore with actuatable members 315 in the contracted state. The contracted state of the actuatable members 315 may be controlled for example by using a hydraulic pressure chamber 320 as the drive mechanism disposed within the base 310 wherein the pressure of the hydraulic pressure chamber 320 may be controlled at a pressure such that the actuatable members 315 are at the contracted state. Extendable, contractable, or collapsible pins may be used for the actuatable members 315 such that the imaging apparatus 300 maybe lowered pass the top of the object 301 to an appropriate position for determining the side dimensions of the fish. For example, the actuatable members 315 may be contractable pins and they may be contracted such that they slide inside the hydraulic pressure chamber 320. Alternatively, the actuatable members 315 may be collapsible pins and they may be collapsed such that they lay almost flat or even flat on the surface of the imaging tool as in a collapsed telescope. An appropriate position will depend on a variety of factors and one of ordinary skill in the art with the benefits of this disclosure may determine the appropriate position. For example, in some operations the device may be allowed to contact the bottom of the wellbore. Once the imaging apparatus 300 is in an appropriate position, the pressure of the drive mechanism 320 may extend the actuatable members, and the imaging apparatus 300 may be allowed to contact the sides of the object 301 and form an impression of the sides of the object 301.

In some embodiments, an imaging apparatus may be used to obtain an impression of the top and the sides of an object. The shape of the imaging apparatus may be designed by a person of ordinary skill in the art with the aid of this disclosure to be able to obtain an impression of both the top and the sides of an object. Alternatively, the imaging apparatus may be designed to obtain an impression of all available aspects of an object that may be contacted with the actuatable members 115 or 315.

In an embodiment, the actuatable members 115 may be protected with a protective casing. The protective casing may shield the actuatable members 115 from the wellbore environment. For example, the actuatable members 115 may be encased inside the protective casing such that the actuatable members 115 are not exposed to the wellbore elements until the imaging apparatus 100 is in an appropriate position and ready for imaging. The protective casing may be shaped or designed appropriate for the shapes and dimensions of the other components of the imaging apparatus 100.

Alternatively, if the base in a sphere such as the base 310 in FIG. 3, the protective casing may be a retractable sphere encasing the actuatable members 315, which may be for example shifted upwards when the imaging apparatus 300 is ready for imaging.

Referring back to FIG. 1, the protective casing 130 may be slideable such that it has an open and closed position. In closed position, the protective casing 130 covers the actuatable members 115. In open position, the protective casing 130 retracts and exposes the actuatable members 115. Prior to using the imaging apparatus 100, the protective casing 130 may be opened to expose the actuatable members 115.

The protective casing 130 may be constructed from any materials that can withstand wellbore conditions. For example, the protective casing 130 may be constructed from metals such as iron, copper, aluminum, lead; alloys such as steel, brass, bronze; organic polymers, synthetic polymers, or combinations thereof.

In an embodiment, the impression apparatus 100 is attached to a line 125 to run it in or out of the wellbore. For example, the line 125 may be attached to the top surface of the impression apparatus 100. The line 125 may be attached in the center or off-center of top surface perpendicular to the base 110. Alternatively, the line 125 may be attached to the surface of the imaging apparatus 100 in one or more attachments.

Herein, a run refers to an operation in which a tool (i.e., the imaging apparatus 100) is lowered into a wellbore, data is collected, and the tool (i.e., the imaging apparatus 100) is retrieved from the wellbore. The line 125 may be a slickline or an electric line. A slickline is a nonelectric line that does not provide power to the impression apparatus 100, for example nonelectric cable, wireline such as single strand or braided strands of metal wires. An electric line may provide power to the impression apparatus 100, for example an electric cable, or a braided strand having a core electric line. An electric line could also be used to send signals to the impression apparatus 100 and/or to receive data and signals from the impression apparatus 100.

The imaging apparatus 100 may be powered. In the case where a slickline is used, the imaging apparatus 100 may be self powered, thus it may further comprise a battery or other power source. In the case where a slickline is used, a memory storage device would have to be included in addition to the battery. In the case where an electric line is used, the electric line may be coupled to a power source that may provide power to the impression apparatus 100.

One or more sensors 111 may be attached to the actuatable members 115. The sensors 111 will be capable of sensing the movement and position of the actuatable members 115 either directly or indirectly for example before, during, and after displacement. Additionally, the sensors 111 may be capable of sensing pressure, for example the pressure at which the actuatable members 115 are displaced, or temperature within the wellbore. One or ordinary skill in the art with the aid of this disclosure will appreciate that there may be other types of sensors suitable for wellbore servicing operations that may be used.

In an embodiment, a sensor 111 may be attached to each of the actuatable members 115. The attachment of the sensor 111 may be at any suitable place, for example at either ends of the actuatable members 115, in between those ends, or above the actuatable members. The sensor 111 may record measurements such as displacement of the actuatable members 111 from their original position for example prior to contact with the object at the extended state or contracted state, during contact with the object, as well as at their displaced state. The sensor 111 may also record other variables such as the displacement force applied to the actuatable member by the drive mechanism.

These recorded measurements (i.e., data) may be saved in the memory device 155. Memory device 155 could be located down hole in the imaging apparatus 100, or at the surface (such as a computer). A memory device could be used at the surface in addition to a memory device in the imaging apparatus. If a slickline (i.e., line 125) is used, data from sensors 111 may be saved in the memory device 155 and may be retrieved when the impression apparatus 100 is retrieved. If an electric line is used, it would also be possible to operate without a memory device, but observing the data real time at the surface.

If an electric line (i.e., line 125) is used, data from sensors 111 may be transmitted via the line 125 to one or more devices on surface with a memory.

In an embodiment, the impression apparatus 100 may be coupled to a computer 140 comprising a memory device 155B for saving the data. In such case, the data obtained from the sensor 111 may be sent to the computer 140 by electronic signal through the line 125 (i.e., electric line). The electric line may provide a pathway for electrical telemetry for communication between the impression tool 100 and the memory saving device 155B. Electrical telemetry allows the impression apparatus 100 to obtain remote measurement and report data from the measurement to a device (e.g., computer 140) or a user at the top of the wellbore. In such case, the data from the impression apparatus 100 may be obtained in real time without the need to retrieve the impression apparatus 100 out of the wellbore for analysis.

The memory 155B may comprise various memory portions, where a number of types of data (e.g., internal data, external data instructions, software codes, status data, diagnostic data, testing profiles, operating guidelines, etc) may be stored. The memory 155B may store various tables or other database content that could be used by a user to facilitate in interpreting the data from the impression apparatus 100. The memory 155B may comprise random access memory (RAM) dynamic random access memory (DRAM), electrically erasable programmable read-only memory (EEPROM), flash memory, hard drives, removable drives, etc.

The computer 140 may be used for other purposes that can be designed by a person skilled in the art with the aid of this disclosure. Examples of other uses of the computer 140 may include without limitation controlling the device, storing the measurements, mapping the measurements, interpreting the measurements, analyzing the measurements, identifying objects, or combinations thereof. The computer 140 may be capable of receiving, generating, and delivering signal from the impression apparatus 100.

In an alternative embodiment, computer 140 and the imaging apparatus 100 may be capable of wireless communication. In such embodiment, computer 140 may further comprise the communication unit 150 coupled to the computer 140 and the wireless communication unit 160 disposed adjacent to the base 110. The communication unit 150 and the wireless communication unit 160 are capable of facilitating communications between the impression apparatus 100 and computer 140. In an embodiment, the communication unit 150 may provide transmission and reception of electronic signals to and from the wireless communication unit 160. In particular, communication unit 150 may be a wireless device capable of transmitting and receiving signal to and from the impression tool 100 through the wireless communication unit 160 without the use of wires. In such embodiment, wherein a slickline is used, the wireless communication unit 160 provides a capability for real time measurement without having to retrieve the impression apparatus 100 of the wellbore.

Once data is received, it may be prepared for analysis. For example data comprising displacement of the actuatable members 115 may be assimilated, mapped, and/or plotted. The data may be interpreted to determine types, sizes, shapes, positions, and/or orientations of contacted objects. The interpretation may be done by a user, or by software in computer 140 capable of interpretation. The software may include any suitable software. For example, the computer 140 may have a database of parts list and dimensions, and the software may compare the data obtained from the impression apparatus 100 to the database. Additionally, the data may be added to the database which may be beneficial for future comparison.

In operation, an impression apparatus may be used during wellbore servicing operations such as fishing operations to image an object (i.e., a fish) within the wellbore. Typically, the imaging apparatus may be mounted at the end of a line. The actuatable members may be in the extended, displaced, or contracted states. If a protective casing is used, it may be encasing the actuatable members to guard them from displacing while the imaging apparatus is being lowered into a wellbore. Alternatively, if a pressure chamber is used, the pressure may be adjusted such that the actuatable members are static while the imaging apparatus is being lowered into a wellbore. When approaching the fish, the protective casing (if present) may be opened or retracted to expose the actuatable members to the fish. At this point, a baseline measurement of the displacement of the actuatable members may be taken, which can be termed zero displacement. The imaging apparatus may be further lowered, the pressure in the pressure chamber may be reduced (e.g., if the actuatable members are in the extended state) or increased (e.g., if the actuatable members are in the contracted state), and contacted with the fish. Upon contact with the fish, the actuatable members may be independently displaced forming a negative impression of the fish. A measurement of a displaced state of the actuatable members may be taken at this point, saved in a memory device, and/or sent for real time recordation and analysis.

If desired, more than one measurement may be made while the imaging apparatus is still inside the wellbore and in proximity to the fish. For example, the imaging apparatus may be retrieved slightly so that it does not contact the fish, the actuatable members may be remotely reset to their original positions prior to contact with the fish as described previously herein. Another baseline measurement may be taken to ensure that the actuatable members returned to their original positions. Then, the imaging apparatus may be lowered and contacted with the fish again. Similarly, another impression of the fish may be formed, saved, and sent for another real time measurement.

Repeated measurements may be taken, and the displacements of the actuatable members may be recorded and sent to a computer for real time analysis. These repeated measurements may be analyzed independently, or may be averaged to get an average displacement measurement. The analysis may be done by a user. Alternatively software may be used to interpret the data, for example by comparing the data with a database of objects that may be located within a wellbore, as described previously herein. The results of the analysis may be used to interpret the fish and a user may select an appropriate fishing tool based on the interpretation to retrieve the fish from the wellbore.

The imaging apparatus of the type disclosed herein may provide the ability to obtain imprints of all available aspects of a fish providing sufficient information about the fish to a user to allow for the selection of an appropriate fishing tool.

The imaging apparatus of the type disclosed herein may be used for repeated measurements without having to retrieve the imaging apparatus from the wellbore between measurements. As disclosed herein, real time measurements may be obtained by using the imaging apparatus thus providing faster data feedback to a user.

The imaging apparatus of the type disclosed herein thus may provide an economical process to identify a fish within a wellbore. Improving the process economics of the wellbore servicing operations include for example reducing the time required to ascertain the type of fish and the selection of an appropriate tool for removal of the fish.

As used herein, the terms "a", "an", "the", and "said" mean one or more.

As used herein, the term "and/or", when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination, or A, B, and C in combination.

As used herein, the terms "comprising", "comprises", and "comprise" are open-ended transition terms used to transition from a subject recited before the term to one or elements recited after the term, where the element or elements listed after the transition term care not necessarily the only elements that make up the subject.

As used herein, the terms "containing", "contains", and "contain" have the same open-ended meaning as "comprising", "comprises", and "comprise", provided below. As used herein, the terms "having", "has", and "have" have the same open-ended meaning as "comprising", "comprises", and "comprise", provided above. As used herein, the terms "including", "includes", and "include" have the same open-ended meaning as "comprising", "comprises", and "comprise" provided above.

The preferred forms of the invention described above and depicted in the drawings are to be used as illustration only, and should not be used in a limiting sense to interpret the scope of the present invention. Modifications to the exemplary embodiments, set forth above, could be readily made by those skilled in the art without departing from the spirit and scope of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. An apparatus for imaging within a wellbore comprising:
a base;
a plurality of actuatable members disposed axially adjacent to the base;
a drive mechanism to extend and contract the actuatable members; and
an actuatable member displacement sensor,
wherein repeated imaging occurs within the wellbore without retrieval of the apparatus from the wellbore.

2. The apparatus of claim 1 wherein the base comprises solid or hollow polyhedron, cylinder, sphere, cone, torus, or combinations thereof.

3. The apparatus of claim 1 wherein the base can be made from a material comprising metal, iron, copper, aluminum, lead, alloys, steel, base, brass, bronze, organic polymers, synthetic polymers, or combinations thereof.

4. The apparatus of claim 1 wherein the actuatable members comprise pins, needles, sticks, welding sticks, rods, wands, spears, spikes, nails, or combinations thereof.

5. The apparatus of claim 4 wherein the actuatable members are extendable, contractable, collapsible, or a combination thereof.

6. The apparatus of claim 4 wherein the actuatable members comprises a pin having a diameter of less than about 2 cm and a length of more than about 1 cm members.

7. The apparatus of claim 5 wherein the actuatable member comprises an extendible and collapsible pin having a diameter of less than about 5 mm.

8. The apparatus of claim 5 wherein the actuatable members comprises an extendible and collapsible pin having a diameter of less than about 2 mm.

9. The apparatus of claim 1 wherein the number of actuatable members is at least five.

10. The apparatus of claim 1 wherein the number of actuatable members per two $cm^2$ is at least one.

11. The apparatus of claim 1 wherein the actuatable members can be made from a material comprising metal, iron, copper, aluminum, lead, alloys, steel, base, brass, bronze, organic polymers, synthetic polymers, or combinations thereof.

12. The apparatus of claim 1 wherein the drive mechanism comprises a pressure chamber, a hydraulic pressure chamber, a spring loaded pressure chamber, a magnetic drive mechanism; an electric drive mechanism, springs, or combinations thereof.

13. The apparatus of claim 1 wherein the actuatable members may be axially displaced upon contact with an object within the wellbore.

14. The apparatus of claim 13 wherein the axially displaced actuatable members form a representation of the object.

15. The apparatus of claim 1 further comprising a protective casing, wherein the protective casing shields the actuatable members from the wellbore environment.

16. The apparatus of claim 1 further comprising a memory device disposed adjacent to the base.

17. The apparatus of claim 16 wherein the memory device stores information concerning the wellbore.

18. A method of servicing a wellbore comprising:
providing an apparatus comprising a base and a plurality of actuatable members disposed axially adjacent to the base, and an actuatable member displacement sensor;
lowering the apparatus into the wellbore to a position near an object within the wellbore;
contacting the actuatable members with the object wherein the contacting comprises axially displacing the actuatable members;
forming a representation of the object;
interpreting the representation of the object; and
using the representation of the object to select a fishing tool to retrieve the object from the wellbore,
repeating the steps without retrieval of the apparatus from the wellbore.

19. The method of claim 18 further comprising saving the representation of the object to a memory device.

20. The method of claim 19 comprising forming multiple representations of the object and comparing the saved representations of the object to identify the object.

* * * * *